US005850791A

United States Patent [19]

Kawaguchi et al.

[11] Patent Number: 5,850,791

[45] Date of Patent: Dec. 22, 1998

[54] SEWING MACHINE HAVING MOVABLE BED

[75] Inventors: Yasuhiko Kawaguchi, Kaizu-gun; Akio Takahashi, Hashima-gun; Masaki Shimizu, Toyoake; Hirokazu Hirose, Chiryu; Yoshikazu Kurono, Hazu-gun, all of Japan

[73] Assignee: Brother Kogyo Kabushiki Kaisha, Nagoya, Japan

[21] Appl. No.: 972,747

[22] Filed: Nov. 18, 1997

[30] Foreign Application Priority Data

Nov. 20, 1996 [JP] Japan ..... 8-309569
Mar. 24, 1997 [JP] Japan ..... 9-070141

[51] Int. Cl.[6] ..... D05B 19/14; D05B 69/24

[52] U.S. Cl. ..... 112/275; 112/220

[58] Field of Search ..... 112/275, 277, 112/220, 221, 155, 163, 300, 181, 470.01, 102.5, 470.06

[56] References Cited

U.S. PATENT DOCUMENTS 4,776,291 10/1988 Tajima et al. ..... 112/221 X
5,133,272 7/1992 Hayashi ..... 112/221
5,718,183 2/1998 Shimizu et al. ..... 112/275

*Primary Examiner*—Peter Nerbun
*Attorney, Agent, or Firm*—Oliff & Berridge, PLC

[57] ABSTRACT

A sewing machine including a needle bar having a sewing needle, a spindle for driving the needle bar, a bed portion movable selectively to a using position or a retracted position, and a rotary hook housed in the bed portion. A stitch is formed by the cooperation of the sewing needle and the rotary hook. A rotary hook drive motor is provided in the bed portion for driving the rotary hook. A sensor is provided for detecting a position of the bed portion. The needle bar and the spindle is selectively disconnected from each other. If the bed portion is out of the using position, and this out position is detected by the sensor, the needle bar is released from the spindle for stopping the sewing needle. Further, in this case, the rotation of the rotary hook drive motor is also stopped.

20 Claims, 11 Drawing Sheets

SEWING MACHINE HAVING MOVABLE BED

BACKGROUND OF THE INVENTION

The present invention relates to a sewing machine which forms stitches by cooperation of a sewing needle and a rotary hook, and more particularly, to the sewing machine having a displaceable bed in which the rotary hook is accommodated.

Recently, there has been proposed a sewing machine having a spindle motor for vertically moving the sewing needle, and a rotary hook drive motor independent of the spindle motor for rotationally driving the rotary hook. In this type of the machine, a bed portion accommodating therein the rotary hook is displaceable to a retracted position spaced away from a head portion for facilitating maintenance to a driving system for the rotary hook.

Further, in the field of the embroidery stitching, a sewing machine having multiple heads are provided, and a large scale workpiece fabric holder or frame is provided which is commonly used for the plurality of heads. With this arrangement, a plurality of workpiece fabrics are held by the fabric holder, so that identical embroidery stitching is performed to the workpiece fabrics simultaneously by the sewing needles of the plurality of heads. Alternatively, a large scale workpiece fabric is held by the holder, and only one of the heads is operated to form a large scale embroidery pattern on the single workpiece fabric. In the latter case, the bed portions which are not used are displaced to their retracted positions, so that the non-used bed portions do not become obstacles for the stitching operation.

If the non-used bed portion which has been displaced to its retracted position is then to be used, the bed portion is moved to the sewing position. However, if driving start timing of the sewing needle and the rotary hook is inaccurate, for example, if the sewing needle and the rotary hook are started to be driven even if the bed portion has not yet reached the operating position, sewing needle-rotary hook meeting timing may become inaccurate, and therefore, the sewing needle may be mechanically interfered with the rotary hook, or a proper stitch seam cannot be formed. Further, the bed portion may be displaced during sewing operation due to some reason. Thus, similar problems may occur.

Generally, the non-use bed portion is positioned at its retracted position. Therefore, idle driving of the rotary hook can be prevented to save electric power. If the sewing needle and the rotary hook are started to be driven while the bed portion is not positioned at the operating position yet the mechanical interference between the needle and the rotary hook does not occur, electric power is consumed in vain, and wasteful load may be imparted on various moving mechanisms. The moving mechanism may break down if threads and fabrics are involved or entangled within these moving mechanisms.

SUMMARY OF THE INVENTION

It is therefore an object of the present invention to provide a sewing machine capable of avoiding mechanical interference between the sewing needle and the rotary hook and inferior or degraded stitching if the bed portion is not positioned at its operating position.

Another object of the invention is to provide such sewing machine capable of avoiding wasteful driving operation of the sewing needle and the rotary hook.

Still another object of the invention is to provide a sewing machine capable of driving other movable components by a spindle yet stopping driving of the sewing needle and the rotary hook.

These and other objects of the present invention will be attained by a sewing machine for stitching a workpiece fabric with a needle thread and a bobbin thread including a base frame, at least one head portion mounted on the base frame, at least one bed portion, a needle bar, judgment means and stitch suspension means. The at least one bed portion is movable between a using position and a retracting position with respect to the at least one head portion. The bed portion accommodates therein a rotary hook containing the bobbin thread. The needle bar has a lower end fixedly provided with a sewing needle through which the needle thread is passed. The needle bar is supported and reciprocally driven by the at least one head portion. A stitch is formed by cooperation of the sewing needle and the rotary hook. The judgment means is adapted for making judgment as to whether or not the at least one bed portion is at the using position. The stitch suspension means is adapted for stopping the cooperation of the sewing needle and the rotary hook when the judgment means determines that the bed portion is out of the using position.

In another aspect of the invention, there is provided a sewing machine including a spindle motor, a spindle driven by the spindle motor, a needle bar, a selective power transmission mechanism, a rotary hook, a rotary hook drive motor, and stitch suspension means. The needle bar is vertically reciprocatingly driven by the spindle and has a lower end fixed with a sewing needle. The sewing needle permits a needle thread to pass therethrough. The selective power transmission mechanism is adapted for selectively providing a power transmission state where the needle bar is drivingly connected to the spindle and a power disconnecting state where the needle bar is disconnected from the spindle. The rotary hook stores therein a bobbin thread, and a stitch is formed on a workpiece fabric by cooperation of the sewing needle and the rotary hook. The rotary hook drive motor is connected to the rotary hook for drivingly rotating the rotary hook. The stitch suspending means is adapted for providing the power disconnecting state of the selective power transmission mechanism and for stopping rotation of the rotary hook drive motor, so that the sewing needle and the rotary hook are in stopped phase while the spindle is still rotating.

BRIEF DESCRIPTION OF THE DRAWINGS

In the drawings:

FIG. 6(*b*) is a side view showing the drive mechanism for driving the thread cutting mechanism according to the embodiment;

FIG. 7(*b*) is a side view showing the geometrical relationship between the retraction sensor and a slightly inclined position of the bed case according to the embodiment;

FIG. 7(*c*) is a side view showing the geometrical relationship between the retraction sensor and a largely inclined position of the bed case according to the embodiment;

DETAILED DESCRIPTION OF THE PREFERRED EMBODIMENTS

A sewing machine according to one embodiment of the present invention will be described with reference to accompanying drawings. The embodiment pertains to an embroidery machine having three heads 1, 2, 3 arranged juxtaposedly with each other.

Figure 1:
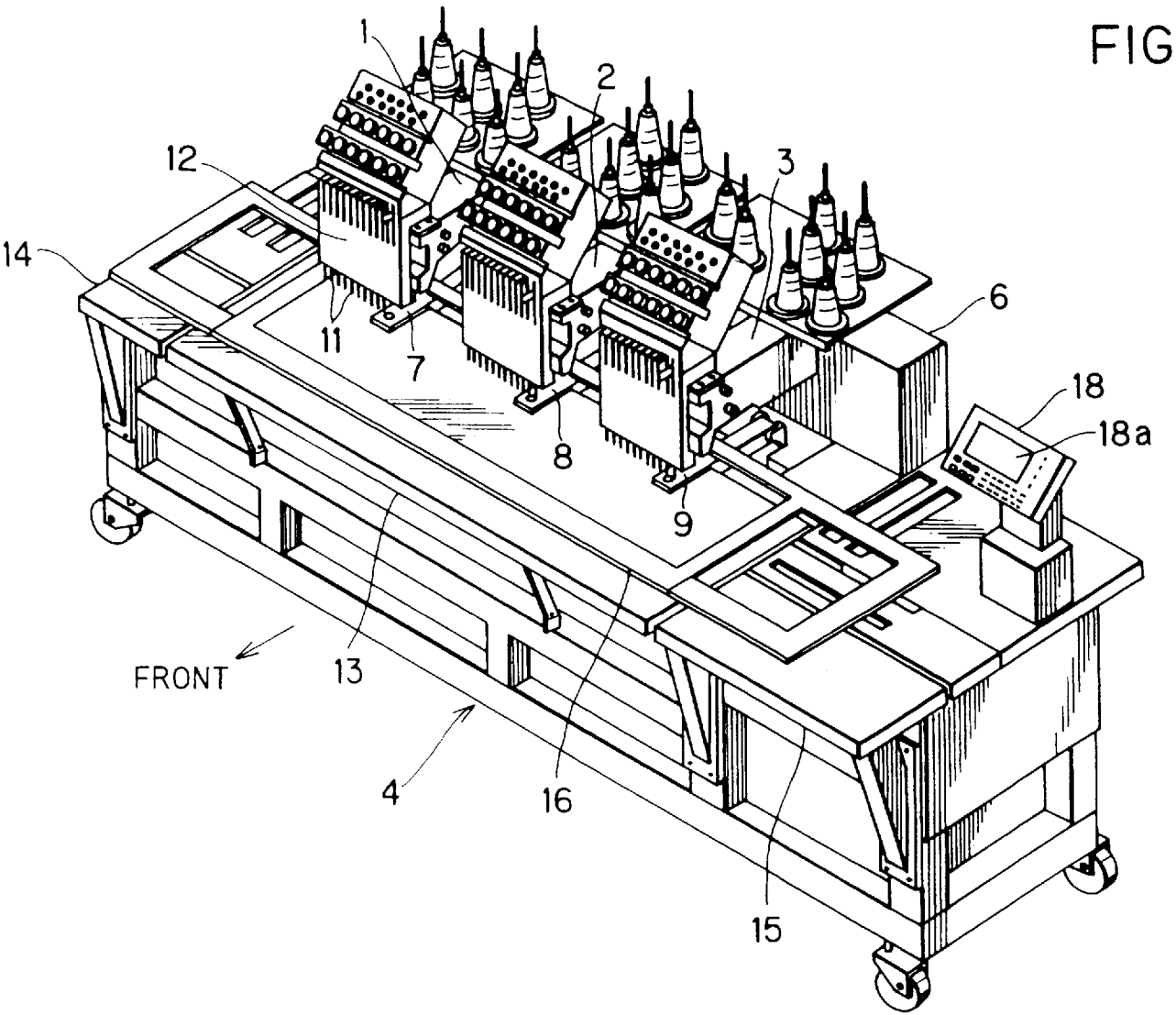
FIG. 1 is a perspective view showing a multi head type sewing machine having multiple needles according to one embodiment of the present invention.

As shown in FIG. 1, the embroidery machine includes a laterally extending base frame 4. The base frame 1 has an upper rear surface from which a laterally extending sewing machine supporting frame 6 upstands. On the supporting frame 6, three head portions 1, 2, 3 are juxtaposed side by side with a predetermined space therebetween. Further, bed portions 7, 8, 9 are provided at the upper surface of the base frame 4 and at positions in confrontation with the head portions 1, 2, 3, respectively.

At each front end portion of each head portion 1, 2, 3, a needle bar case 12 is laterally movably supported. In each needle bar case 12, twelve needles 11 arrayed in the lateral direction are vertically movably supported.

A work table 13 extending in a horizontal direction is provided at the upper front surface of the base frame 4. The height of the work table 13 can be changed so that the upper surface of the work table 13 can be flush with the upper surface of the beds 7, 8, 9. A pair of auxiliary tables 14, 15 are provided at lateral ends of the work table 13. Further, a workpiece holder 16 having a rectangular shape and extending in the lateral direction is mounted on the pair of auxiliary tables 14, 15 and on the work table 13.

Figure 8:
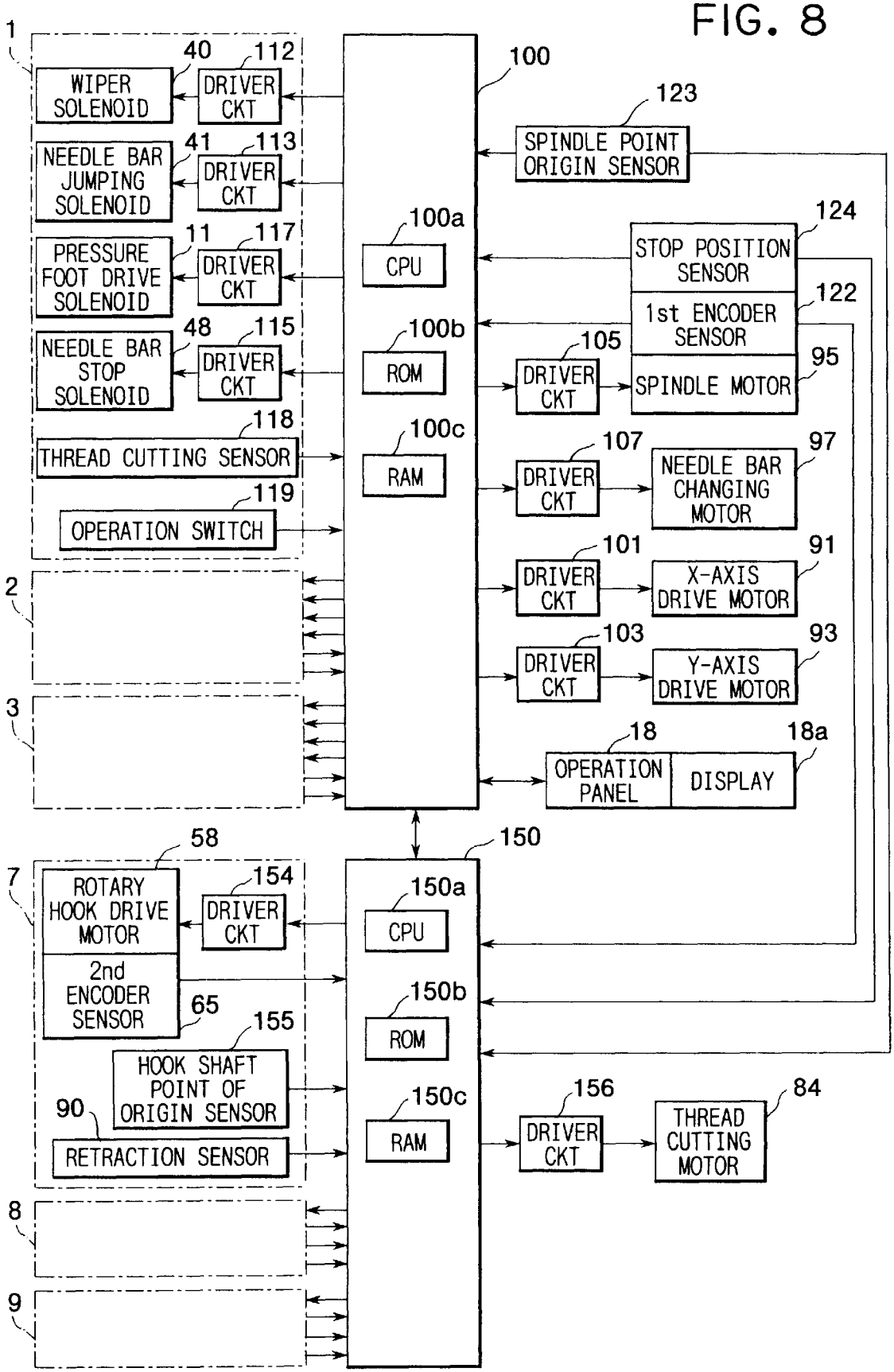
FIG. 8 is a block diagram showing a control system of the sewing machine according to the embodiment.

The workpiece holder 16 is adapted to hold a workpiece fabric 99 (FIG. 2) and is movable in X-axis direction, i.e., the lateral direction (rightwardly and leftwardly in FIG. 1) by an X-axis drive motor 91 (FIG. 8) and in Y-axis direction (frontwardly and rearwardly in FIG. 1) by Y-axis drive motor 93 (FIG. 8). Further, at the rear side of the auxiliary table 15, an operation panel 18 is provided for inputting various commands. The operation panel 18 includes a display 18*a* for displaying a message in connection with the embroidery stitching.

Next, a needle bar driving mechanism 20 for vertically moving needle bars 19 will be described with reference to FIGS. 2 and 3. At the front end portion of each of the head portions 1, 2, 3, a head frame 50 (FIG. 3) is provided. Further, a master needle bar 21 extending in the vertical direction is supported to the head frame 50. That is, the head frame 50 has a front end portion to which upper and lower end portions of the master needle bar 21 is fixed. A vertically movable segment 22 is vertically movably supported to and around the master needle bar 21. The vertically movable segment 22 is engageable with a linking pin 19*a* of the needle bar 19.

The movable segment 22 has a lower end portion provided with a drive piece 23 which is vertically movable and unrotatable relative to the master needle bar 21. That is, the vertically movable segment 22 is vertically movable along with the vertical movement of the drive piece 23, and is rotatable about an axis of the mater needle bar 21 with respect to the drive piece 23.

A pivot shaft 24 extending in a horizontal direction is supported in the head frame 50, and a pivot lever 25 is provided pivotably movably about the pivot shaft 24. The drive piece 23 is pivotally connected to a link 26 pivotally connected to the pivot lever 25.

A single spindle 27 extends in the lateral direction through the head portions 1, 2, 3. The spindle 27 is driven by a spindle motor 95 (FIG. 8). An eccentric cam 28 is fixedly mounted on the spindle 27, and an eccentric lever 29 is disposed over the eccentric cam 28. The eccentric lever 29 has a lower end pivotally connected to an intermediate portion of the pivot lever 25. Thus, rotation of the spindle 27 provides vertical reciprocating movement of the eccentric lever 29, which causes vertical reciprocating movement of the vertically movable segment 22 via the pivot lever 25, the link 26 and the drive piece 23.

The vertically movable segment 22 has a pair of engaging projections 22*a*, 22*b* spaced away from each other in the vertical direction, and the linking pin 19*a* is selectively engageable between the engaging projections 22*a* and 22*b*. Thus, the vertical reciprocating movement of the vertically movable segment 22 can be transmitted to the needle bar 19 and the sewing needle 11. At a position above the vertically movable segment 22, a vertically movable spring seat 35 is slidably fitted over the master needle bar 21. A coil spring 36 is disposed around the master needle bar 21 and is interposed between the spring seat 35 and the vertically movable segment 22. The coil spring 36 is adapted to rotationally urge the vertically movable segment 22 about the master needle bar 21 toward its linking position shown by a solid line in FIGS. 2 and 3. In other words, the coil spring 36 urges the vertical movable segment 22, so that the pair of engaging projections 22*a* and 22*b* are oriented toward the needle bar 19 to engage the linking pin 19*a*. Each one of the linking pins 19*a* of each one of the needle bars 19 can be selectively engaged with the engaging projections 22*a* and 22*b* when the needle bar case 12 is moved in the lateral direction.

Figure 2:
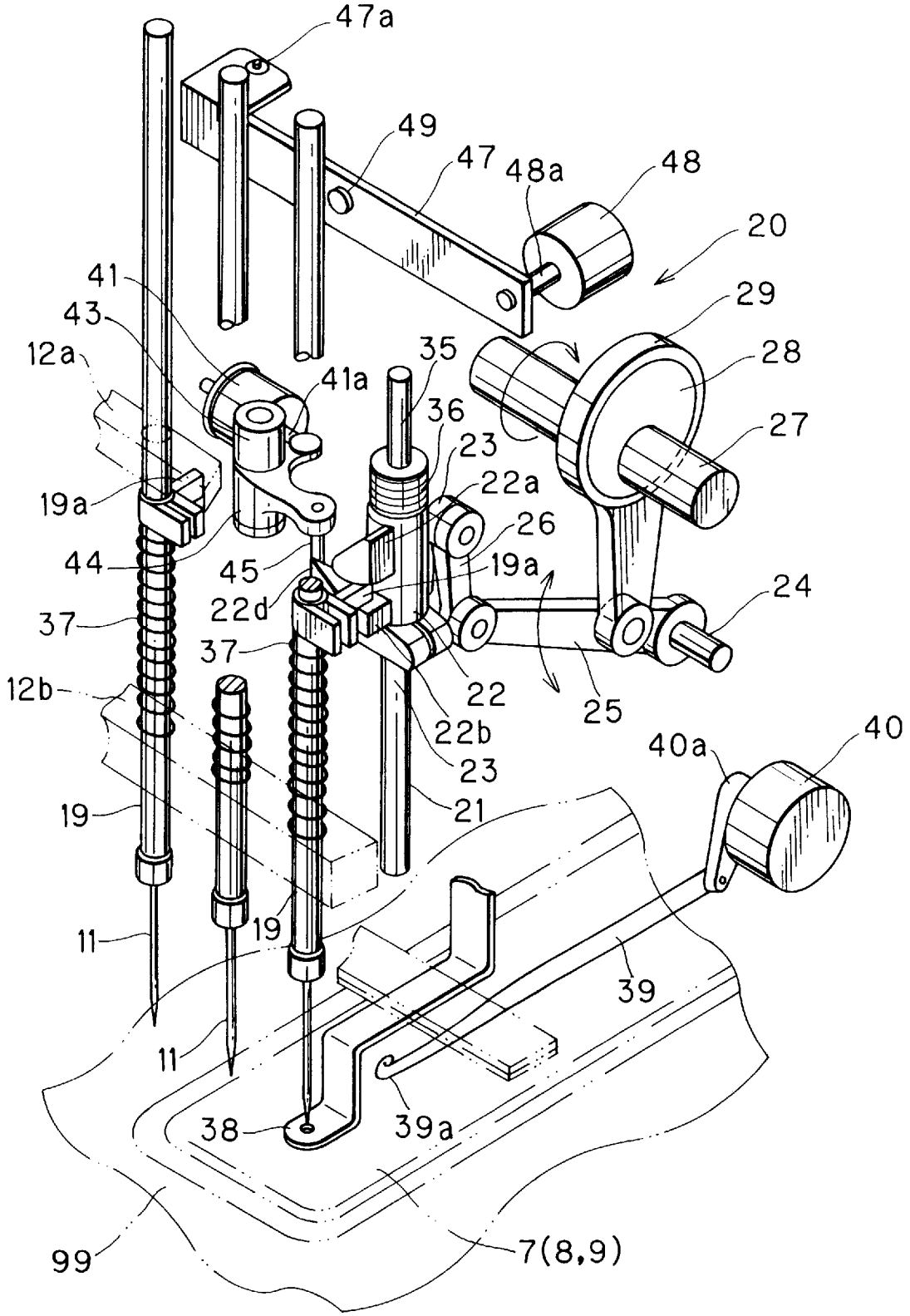
FIG. 2 is a schematic perspective view showing a needle bar driving mechanism according to the embodiment.

As shown in FIG. 2, each needle bar 19 is vertically movably supported to support frames 12*a* and 12*b* of the needle bar case 12. A compression spring 37 is disposed around the needle bar 19 and interposed between the linking pin 19*a* and the lower support frame 12*b*, so that the needle bar 19 is urged to its upper needle position by the biasing force of the compression spring 37.

A pressure foot 38 is provided at each of the beds 7, 8, 9 for holding the workpiece fabric 99. The pressure foot 38 is connected to a pressure foot drive solenoid 111 (FIG. 8). A wiper 39 and a wiper solenoid 40 for driving the wiper 39 are provided behind the pressure foot 38. The wiper 39 has a front end provided with a hook 39*a* for trapping and holding the needle thread after cutting the same. The wiper 39 has a rear end connected to the wiper solenoid 40 via an arm 40*a*. The wiper solenoid 40 is a rotary solenoid for pivotally moving the arm 40*a* upon electrical power supply, so that the hook 39*a* is movable into and retracted from a location immediately below the sewing needle 11. The pressure foot 37 and the wiper 39 can be referred to as actuators.

A direct-acting type needle bar jumping solenoid 41 is provided at a left end wall of the head frame 50. The solenoid 41 has a plunger 41*a* extending in the horizontal direction. Further, an angularly movable L-shaped lever 43 is provided between the needle bar jumping solenoid 41 and the vertically movable segment 22. The L-shaped lever 43 is pivotable in a horizontal plane and is movably supported by a pin 44. The L-shaped lever 43 has one end pivotally connected to the plunger 41*a* of the solenoid 41. The L-shaped lever 42 has another end portion provided with an operation shaft 45 extending in the vertical direction. A tension spring 46 is interposed between the head frame 50 and the other end portion of the L-shaped lever 42 for urging the L-shaped lever 43 to pivot in a counterclockwise direction in FIG. 3. The above described engaging projection 22*a* of the vertically movable segment 22 has an abutment piece 22*d* to which the operation shaft 45 is abutable. The operation shaft 45 is of a tubular shape and has a sufficient length greater than a vertical moving stroke of the needle bar 19. Therefore, the operation shaft 45 is abutable on the abutment piece 22*d* regardless of the position of the needle bar 19.

Figure 3:
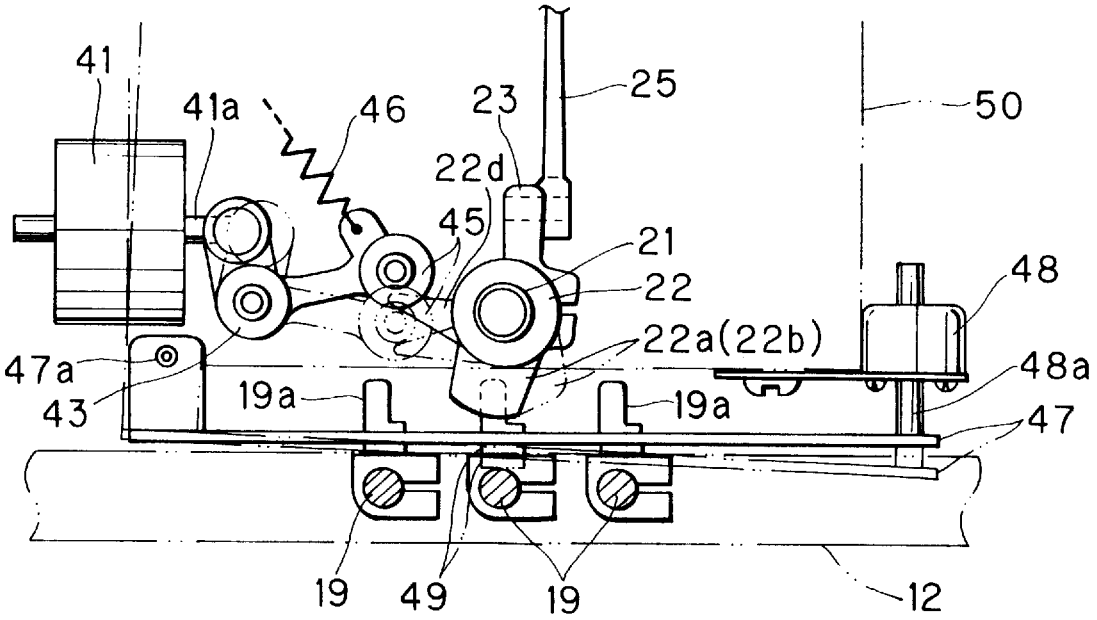
FIG. 3 is a plan view showing the needle bar driving mechanism.

With this structure, if the needle bar jumping solenoid 41 is actuated upon electric power supply to the solenoid for a predetermined period to extend its plunger 41*a* when the needle bar 19 is connected to the vertically movable segment 22 by way of the linking pin 19*a*, the pivot lever 43 is angularly moved in a clockwise direction to a two dotted chain line position in FIG. 3. Therefore, the operation shaft 45 pushes the abutment piece 22*d* frontwardly (in the counterclockwise direction in FIG. 3). Thus, the vertically movable segment 22 is pivotally moved about the master needle bar 21 against the biasing force of the coil spring 36, so that the pair of engaging projections 22*a*, 22*b* are disengaged from the linking pin 19*a*. Accordingly, the driving force from the spindle 27 is not transmitted to the needle bar 19.

On the other hand, if the electrical power supply to the needle bar jumping solenoid 41 is shut off, the L-shaped pivot lever 43 is pivoted in the counterclockwise direction in FIG. 3 by the biasing force of the tension spring 46. Therefore, the operation rod 45 is moved rearwardly away from the abutment piece 22*d*. Thus, the vertically movable segment 22 can be pivotally moved in the clockwise direction in FIG. 3 to a position indicated by a solid line by the biasing force of the coil spring 36. Consequently, the linking pin 19*a* is brought into engagement with the pair of engaging projections 22*a* and 22*b*, and as a result, the needle bar 19 is drivingly connected to the spindle 27.

A swing plate 47 extending in the horizontal direction has one end pivotally movably secured to the upper portion of the head frame 50 by a hinge 47, and another end connected to a plunger 48*a* of a needle bar stop solenoid 48 secured to the head frame 50. The swing plate 47 has a front surface provided with a rubber piece 49 by which one needle bar 19 of the plurality of needle bars is pressed. That is, in accordance with the lateral movement of the needle bar case 12, only one needle bar 19 is drivingly connected to the vertically movable segment 22, and the only one needle bar 19 is vertically reciprocatingly movable. The rubber piece 49 is positioned in confrontation with the moving needle bar 19.

Upon electrical power supply to the needle bar stop solenoid 48 to extend the plunger 48a frontwardly, the swing plate 47 is pivotally moved frontwardly as shown by a two dotted chain line in FIG. 3, so that the rubber piece 49 presses against the needle bar 19. Therefore, the rubber piece 49 exerts braking force on the needle bar 19. If electrical power supply to the needle bar stop solenoid 48 is shut off, the swing plate 47 is retracted rearwardly, so that the rubber piece 49 is moved away from the needle bar 19, to permit the needle bar 19 to be vertically movable.

Next, the bed portions 7, 8, 9 will be described with reference to FIGS. 4 through 7. These bed portions are identical with one another, and therefore, description will be made on the leftmost bed portion 7 only. A bed case 51 having a substantially U-shape cross-section extends in the frontward/backward direction. The rear end of the bed case 51 is fixed to the base frame 4. A throat plate 52 is positioned at the upper front end of the bed case 51. The front portion of the bed case 51 is detachably provided with a rotary hook module 55.

Figure 5:
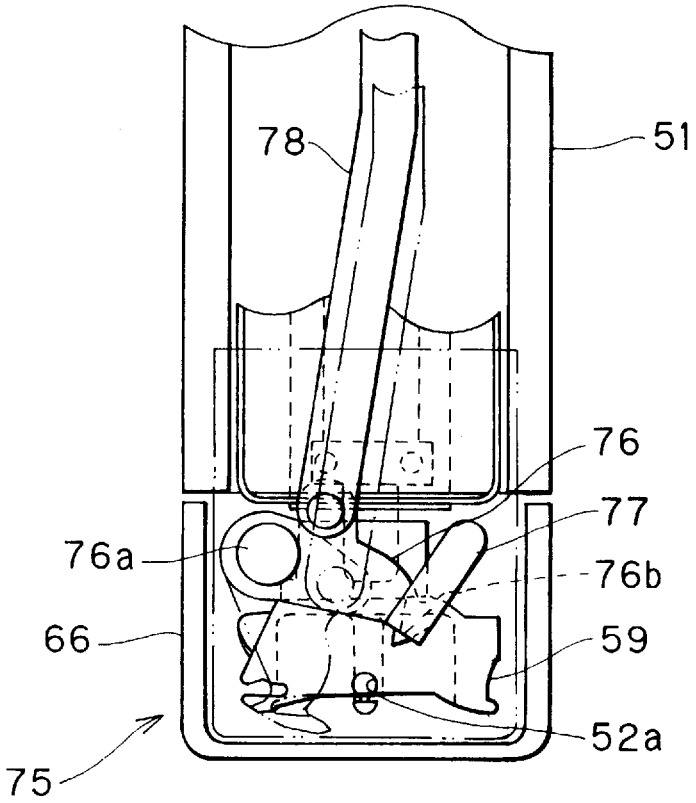
FIG. 5 is a plan view showing a thread cutting mechanism according to the embodiment.
Figure 4:
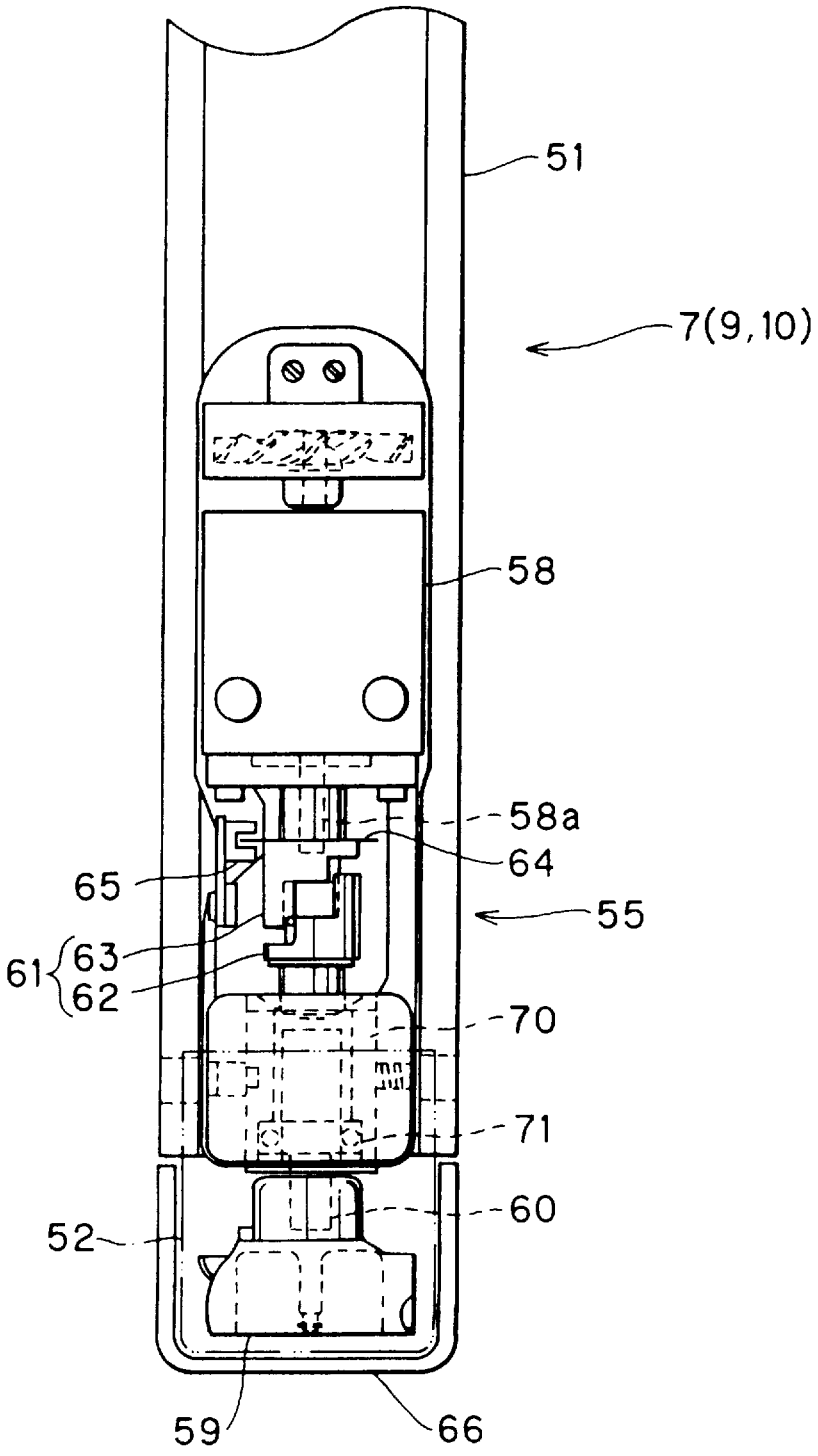
FIG. 4 is a plan view showing a rotary hook module according to the embodiment.

Next, the rotary hook module 55 will be described with reference to FIGS. 4 through 6. The rotary hook module 55 includes a rotary hook drive motor 58 such as a stepping motor and a rotary hook or a loop taker 59 positioned immediately below the needle bar 19 for trapping a thread loop. The rotary hook 59 has a hook shaft 60 having a rear end portion fixed with a first coupling member 62, and the rotary hook drive motor 58 has a drive shaft 58*a* fixed with a second coupling member 63. The first and second coupling members 62 and 63 are coupled together, to provide a coupling 61. Thus, the hook shaft 60 and the drive shaft 58*a* are coupled together by the known coupling 61.

Further, the second coupling member 63 is provided with a disc encoder 64 formed with a plurality of slits. A second encoder sensor 65 such as a photosensor is attached to a side wall of the bed case 51 for optically detecting the plurality of slits and generating a hook shaft rotation signal. A bearing case 70 in which bearings are forth fitted is disposed over the hook shaft 60.

Next, a thread cutting mechanism 75 will be described with reference to FIG. 5. This mechanism is provided in each of the bed portions 7, 8, 9 for cutting the needle thread and a bobbin thread and at positioned above the respective rotary hooks 59.

A movable blade 76 is pivotable about a support shaft 76*a* projecting behind the rotary hook 59. The movable blade 76 is movable between a stand-by position shown by a solid line in FIG. 5 and a maximum pivot position shown by a two dotted chain line. The movable blade 81 has an engaging portion 76*b*. A stationary blade 77 is provided below the throat plate 52. The stationary blade 77 has a blade edge orienting frontwardly for cutting the needle thread and bobbin thread in cooperation with the movable blade 76.

A thread cutting operation lever 78 is pivotally connected to the movable blade 76 and extends rearwardly in the bed case 51. That is, upon frontward movement of the thread cutting operation lever 78, the movable blade 76 is pivotally moved in a clockwise direction in FIG. 5 to the maximum pivot position indicated by the two dotted chain line. Then, the thread cutting operation lever 78 is moved rearwardly, so that the movable blade 76 is pivotally moved in a counterclockwise direction about the support shaft 76*a*. During this counterclockwise movement, the needle thread passing through a needle hole 52*a* of the throat plate 52 and the bobbin thread supplied from the rotary hook 59 are trapped by the engaging portion 76*b* of the movable blade 76, and then, these threads are cut simultaneously by the movable and stationary blades 76 and 77.

A thread cutting driving mechanism for driving the thread cutting mechanism 75 will next be described with reference to FIGS. 6(*a*) and 6(*b*). A bracket 81 is fixed to the base frame 4 near a rear end of the bed case 51, and the rear end of the bed case 51 is pivotally connected to the bracket 81 by a horizontally extending pivot shaft 82. Therefore, the front end of the bed case 51 is movable in the vertical direction.

A thread cutting operation shaft 83 extends in the lateral direction at a position in front of the pivot shaft 82 and above the bed case 51. The thread cutting operation shaft 83 is connected to a thread cutting motor (FIG. 8) through a link mechanism (not shown), so that the thread cutting operation shaft is movable in its axial direction upon rotation of the thread cutting motor 84. A link piece 85 is fixed to the thread cutting shaft 83 at a position above each bed case 51. Each link piece 85 has a downwardly extending pin 85*a*. Further, a pivot lever 86 having an L-shape configuration in plan view is pivotally movably supported about a pivot shaft 86*a* extending vertically from the bed case 51. Therefore, the pivot lever 86 is pivotable in a horizontal plane. The pivot lever 86 has a rear arm portion formed with an oblong slot 86*b* with which the downwardly extending pin 85*a* of the link piece 85 is engageable. The pivot lever 86 has a front arm portion to which a rear end of the operation lever 78 is pivotally connected. If the bed case 51 is pivotally moved to its using position, i.e., horizontal position, the pin 85*a* is brought into engagement with the oblong slot 86*b*. Then, if the thread cutting operation shaft 83 is moved in its axial direction, i.e., lateral direction by the thread cutting motor 84, this axial movement is converted into the pivotal movement of the L-shaped lever 86 via the link piece 85. Thus, the operation lever 78 is moved in the frontward/backward direction. Accordingly the movable blade 76 is pivotally moved for cutting the needle and bobbin threads.

Figure 6A:
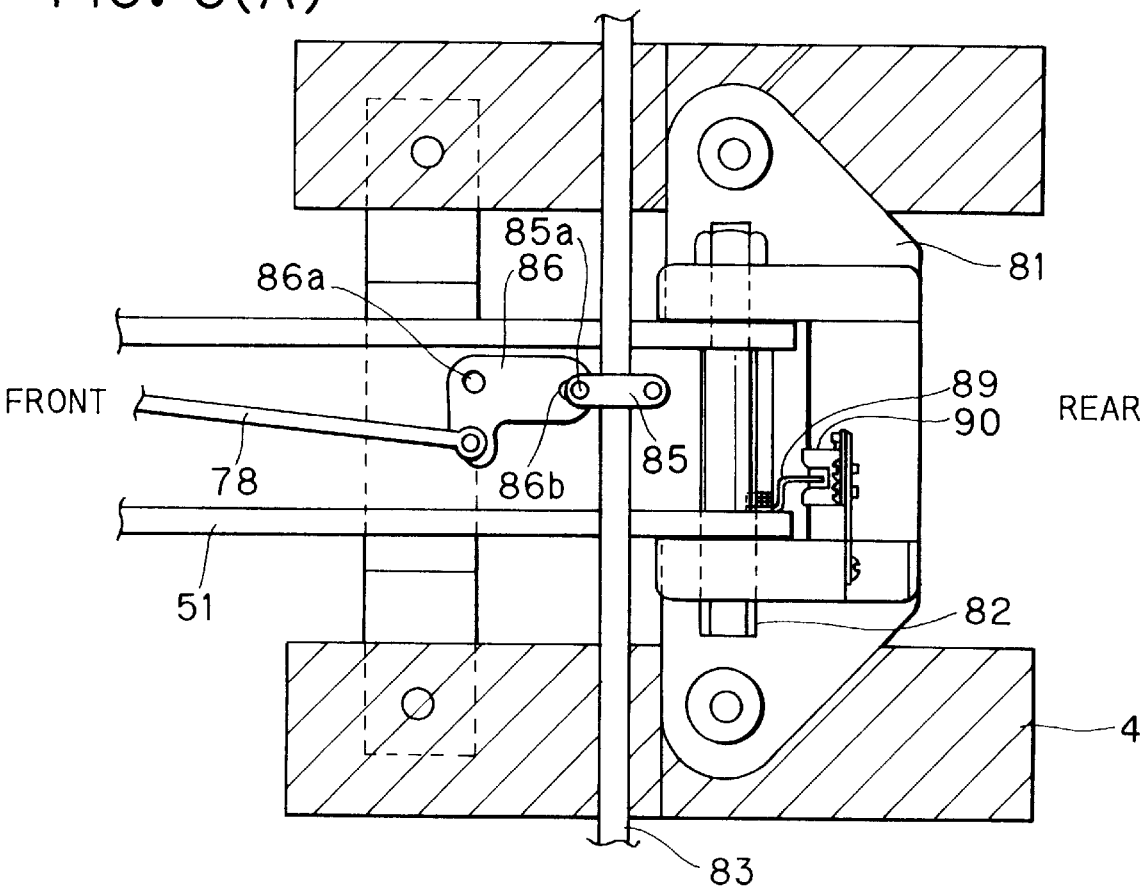
FIG. 6(*a*) is a plan view showing a drive mechanism for driving the thread cutting mechanism according to the embodiment.
Figure 6B:
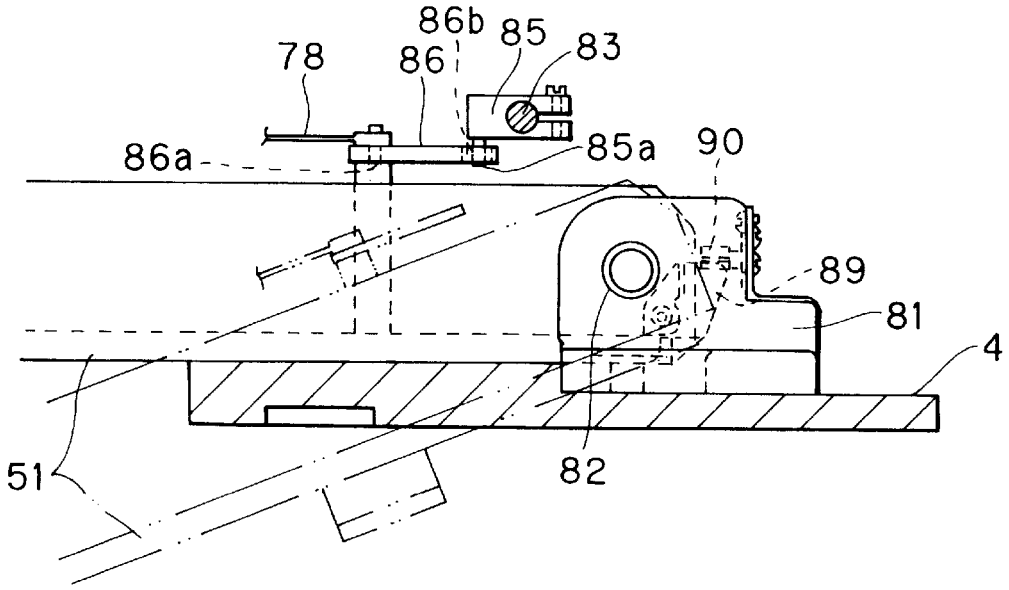

If the bed case 51 is moved to its retracted position shown by two dotted chain line in FIG. 6(*b*), the pin 85*a* is disengaged from the oblong slot 86*b*. Therefore, the driving force of the thread cutting operation shaft 83 is not transmitted to the pivot lever 86. Therefore, even if the thread cutting motor 84 is energized, the movable blade 76 is not moved. Incidentally, as a matter of convenience for explanation, the pivot lever 86 and its associated components are delineated in FIG. 6(*b*) at more upward positions than their actual positions.

A detecting arrangement for detecting the position of the bed case 71 is shown in FIGS. 6(*a*) through 7(*c*). A light shield plate 89 having a generally sector shape protrudes rearwardly from the rear end of the bed case 51. Further, a retraction sensor 90 such as a photo-sensor is provided at the bracket 81 for optically detecting the passing of the light shield plate 89 through the sensor 90. The retraction sensor 90 has a detecting portion 90*a* at which a light path is provided.

Figure 7A:
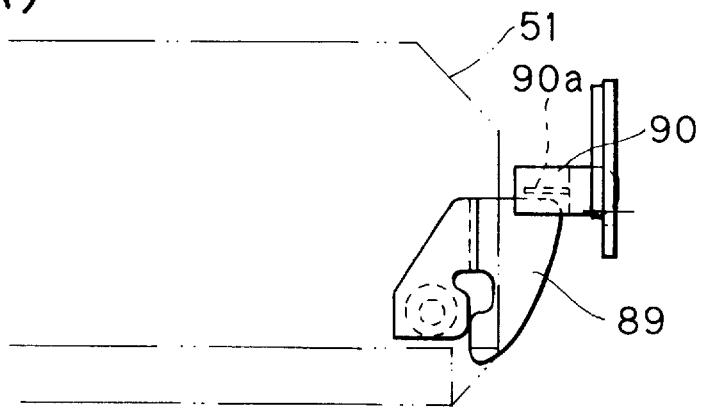
FIG. 7(*a*) is a side view showing a geometrical relationship between a retraction sensor and a using position of a bed case according to the embodiment.
Figure 7B:
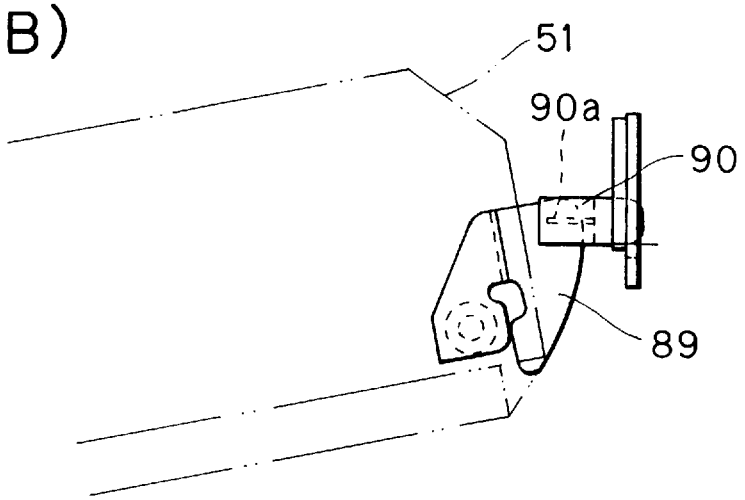
Figure 7C:
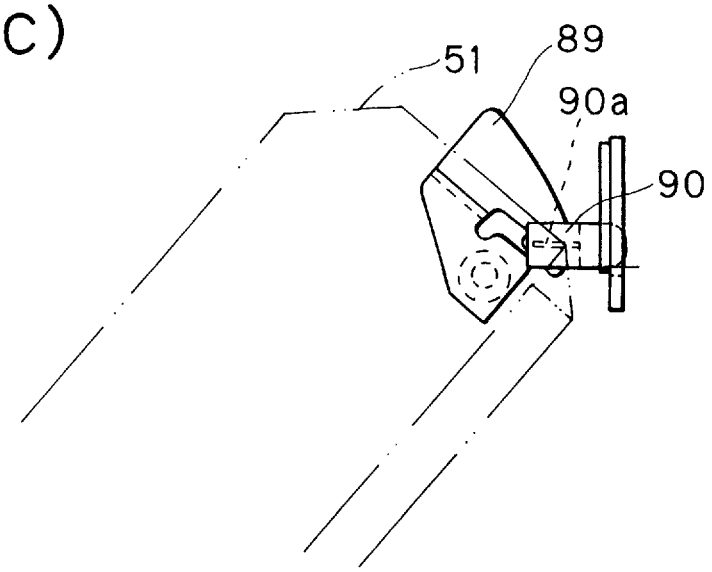

As shown in FIG. 7(*a*), if the bed case 51 is positioned at its using position, the light path at the detecting portion 90*a* is not shielded by the shield plate 89. On the other hand, if the bed case 51 is slightly moved out of its using position as shown in FIG. 7(*b*), or if the bed case 51 is completely moved to its retracting position as shown in FIG. 7(*c*), the light beam at the detecting portion 90*a* is shielded by the shield plate 89. Accordingly, position of the bed case 51 can be detected in accordance with a detection signal generated from the retraction sensor 90.

Within the base frame 4, are accommodated the above described X-axis motor 91 for moving the workpiece holder 16 in the X-direction, Y-axis motor 93 for moving the holder 16 in Y-direction, the spindle motor 95 for rotating the spindle 27, and a needle bar changing motor 97 for laterally moving the needle bar case 12. These motors 91, 93, 95, 97 are connected to a sewing machine control circuit 100 housed in the base frame 4.

The sewing machine control circuit 100 is adapted for controlling the entire embroidery machine except for a control to the driving mode of the rotary hook 59. As shown in FIG. 8, the control circuit 100 is provided with a microcomputer including a CPU 100*a*, a ROM 100*b* and a RAM 100*c*. The above described motors 91, 93, 95, 97 are connected to the control circuit 100 via driver circuits 101, 103, 105 and 107, respectively. Further, to the control circuit 100, are connected, with respect to the head portion 1, the wiper solenoid 48 via a driver circuit 112, the needle bar jumping solenoid 41 via a driver circuit 113, the needle bar stop solenoid 48 via a driver circuit 115, the pressure foot drive solenoid 111 via a driver circuit 117, a thread cutting sensor 118 for detecting the thread cutting at the head portion 1, and a manual operation switch 119 for switching start and stop of operation of the sewing needle 11 and the corresponding rotary hook 59 by the manual operation. These are provided with respect to the head portions 2 and 3, respectively.

A first encoder sensor 122 is connected to the control circuit 100. The first encoder sensor 122 generates a thousand slit signals or spindle rotation signals upon a single rotation of the spindle motor 95. A point of origin sensor 123 is also connected to the control circuit 100 for generating a single signal indicative of a point of origin of the spindle 17 upon a single rotation of the first encoder sensor 122. A stop position sensor 124 is connected to the control circuit 100 for detecting a stop position of the needle bar 19, i.e., at a rotation angle of 100° of the spindle 27 from an upper dead center of the needle bar 19. Further, the operation panel 18 provided with the display 18*a* and various switches are connected to the control circuit 100.

A hook shaft control circuit or a second control circuit 150 is connected to the control circuit 100 for controlling driving mode of the rotary hook 59 and thread cutting operation. The hook shaft control circuit 150 is provided with a microcomputer including a CPU 150*a*, a ROM 150*b* and a RAM 150*c*. Regarding the bed portion 7, the rotary hook drive motor 58 (FIG.4) is connected to the second control circuit 150 through a driver circuit 154, and the second encoder sensor 65 (also shown in FIG. 4) and a hook shaft point of origin sensor 155 are also connected to the second control circuit 150. The second encoder sensor 65 is adapted to generate fifty slit signals (hook shaft rotation signal) upon a single rotation of the disc encoder 64 (FIG. 4) connected to the rotary hook drive motor 58. The point of origin sensor 155 is adapted to generate a single synchronization signal of the hook shaft upon a single rotation of the disc encoder 64. Further, the above described retraction sensor 90 is also connected to the second control circuit 150. These are also provided with respect to the bed portions 8 and 9.

Further, the thread cutting motor 84 is connected to the second control circuit 150 via a driver circuit 156. The first encoder sensor 122, the spindle point of origin sensor 123 and the stop position sensor 124 are also connected to the second control circuit 150.

The hook shaft drive control routine executed by the hook shaft control circuit 150 will be described with reference to flowcharts shown in FIGS. 9 and 10. First, signals output from the sewing machine control circuit 100 to the hook shaft control circuit 150 will be described. At an initial start up phase of the sewing operation, the spindle 27 is stopped at its angular stop position and the needle bar 19 is positioned at its uppermost position (jumping position) because of release of the needle bar 19 from the vertically movable segment 22. If the stitching operation is carried out based on embroidery data containing N-times needle location data, the sewing machine control circuit 100 outputs H level spindle drive signal and rotation of the spindle motor 95 is started. The needle bar 19 is then immediately engaged with the vertically movable segment 22 for starting its vertically reciprocating movement. If N-times stitching Is completed, the sewing machine control circuit 10 outputs L level spindle drive signal, and the spindle 27 is stopped at its angular stop position and outputs a thread cutting signal.

Figure 9:
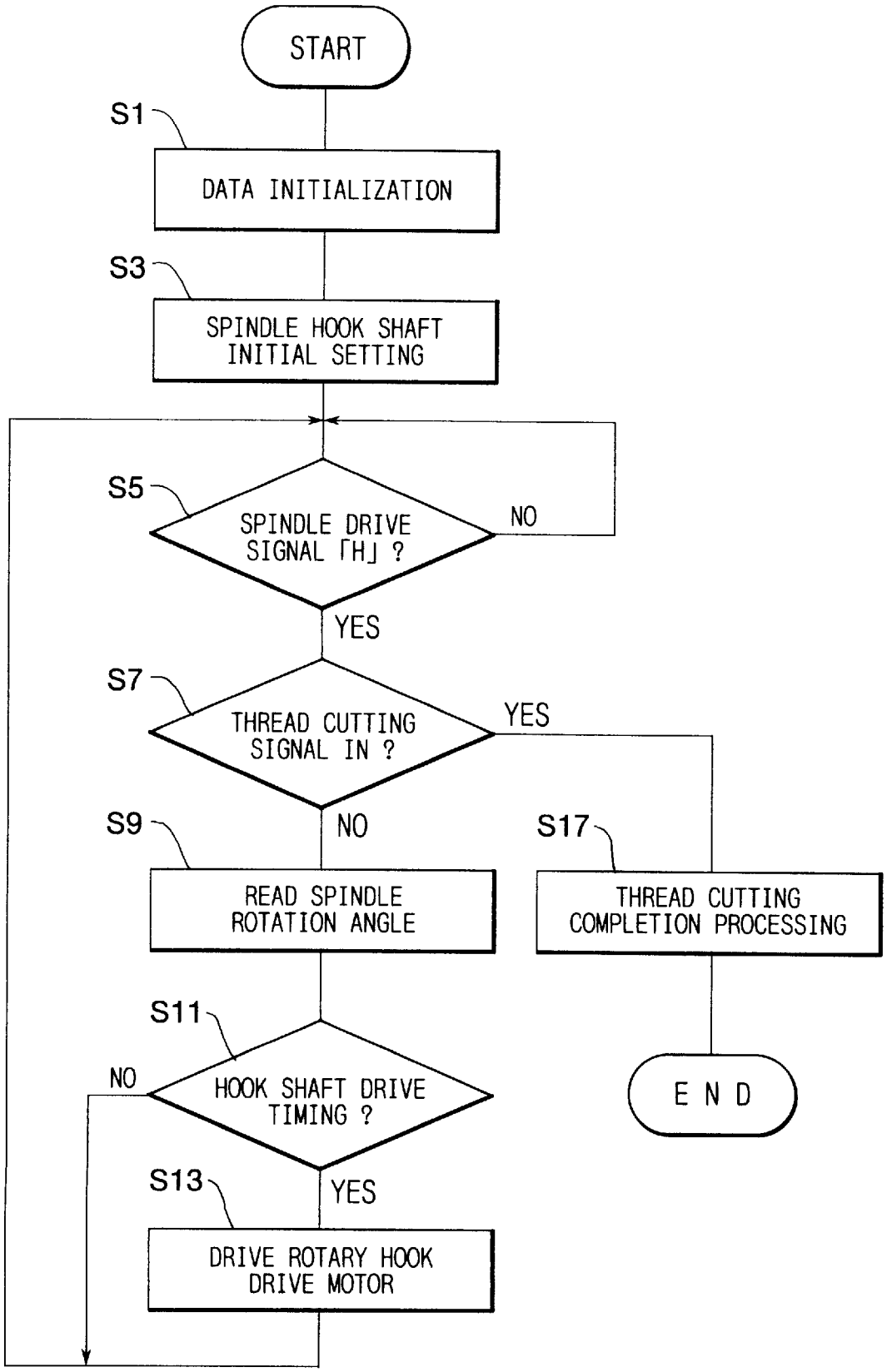
FIG. 9 is a flowchart showing a hook shaft drive control routine according to the embodiment.

Hook shaft drive control routine of FIG. 9 will be started upon electric power supply. First, in step S1, data initialization is executed such that resetting of a timer and a counter is performed. Then, in S3, initial setting for the spindle and the hook shaft is executed. That is, the hook shaft 60 Is rotated to its point of origin position, and the spindle 27 is stopped at its stop position. More specifically, the rotary hook drive motor 58 is driven to rotationally move the hook shaft 60 to its point of origin where the hook shaft point of origin sensor 155 generates the hook shaft synchronization signal. Driving timing of the rotary hook drive motor 58 is, however, suspended until the spindle 27 reaches its angular stop position as a result of judgment by the stop position sensor 124. If the spindle 27 is not at its stop position, the sewing machine control circuit 100 transmits display signal to the display 18*a* where an error message is displayed. An operator can note this error and manually rotate the spindle 27 to its stop position. Then, the hook shaft 60 is rotated to its point of origin.

Then, in step S5, judgment is made as to whether or not the signal output from the sewing machine control circuit 100 is H level signal. If the signal is L level signal (S5:No), the routine returns back to S5 to repeat the judgment. If the signal is H level signal (S5:Yes), the routine proceeds to step S7. In S7, judgment is made as to whether or not the thread cutting signal is output from the sewing machine control circuit 100. If the thread cutting signal has not yet been output (S7:No), the routine goes into S9 where rotation angle of the spindle 27 is read by the first encoder sensor 122 and the spindle point of origin sensor 123. Then in step S11, judgment is made as to whether or not the present timing is the driving timing of the hook shaft 60 based on the read rotation angle of the spindle 27. If the judgment falls No, the routine returns back to S5. If the judgment falls Yes, the rotary hook drive motor 58 is driven by one step in S13 and then the routine returns back to S5.

By repeating the steps S5 through S13, stitches can be formed on the workpiece fabric 99 by co-operation of the sewing needle 11 and the rotary hook 59. If N-times stitching is completed and the thread cutting signal is transmitted from the sewing machine control circuit 100, the judgment in the step S7 falls Yes, so that the routine proceeds into S17. In S17, the hook shaft 60 is rotated by a predetermined amount for obtaining a proper residual length of the needle thread, the residual length being a length extending from the thread hole of the sewing needle to the cut end of the thread. Further, the thread cutting motor 84 is driven to cut the needle thread and the bobbin thread simultaneously. Thus, thread cutting completion processing is ended.

Figure 10:
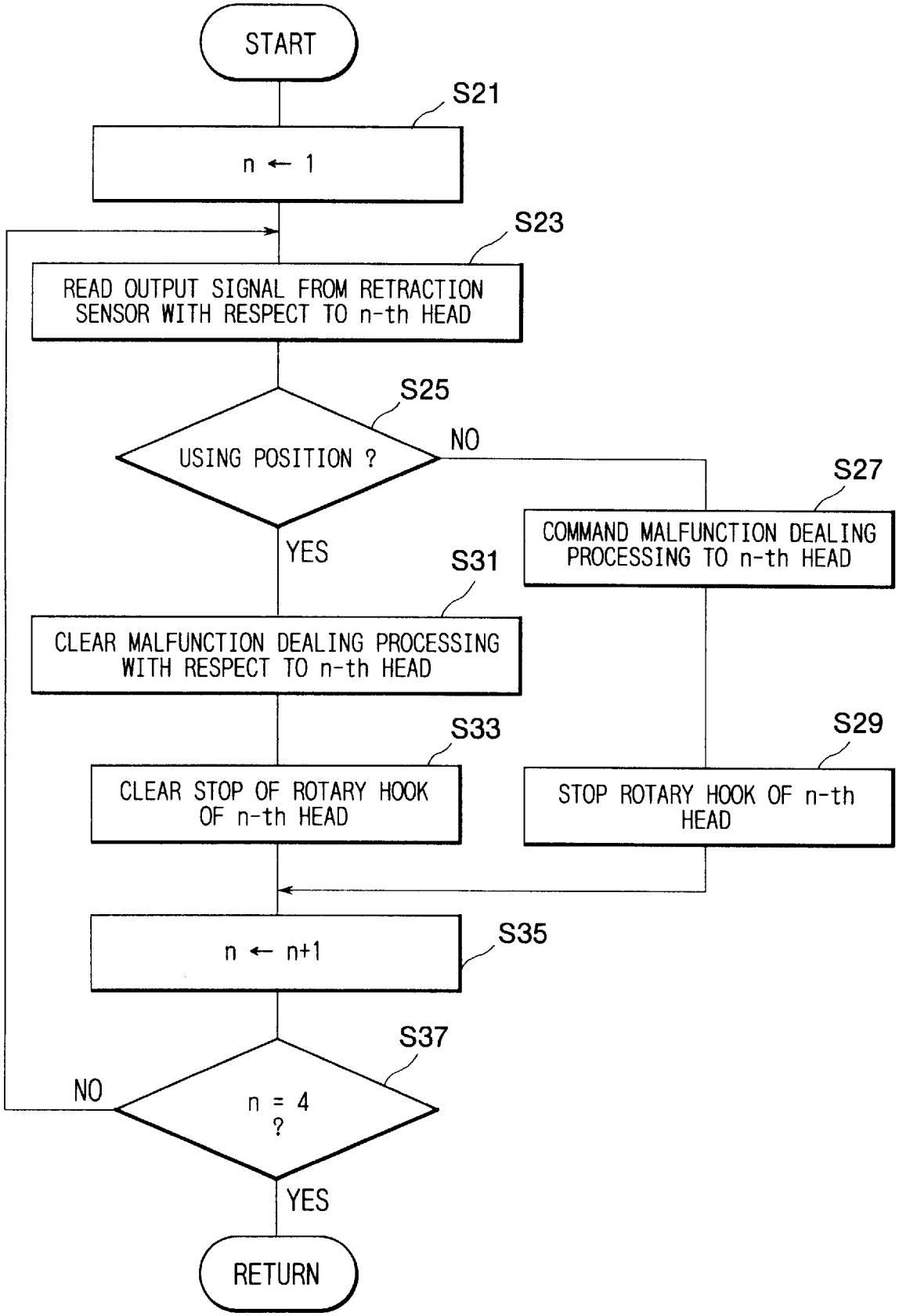
FIG. 10 is a flowchart showing a control routine for stopping drive of the hook shaft in case of inadvertent positioning of the bed case according to the embodiment.

During the above described hook shaft drive control processing, the hook shaft control circuit 150 executes shunting processing shown in FIG. 10 by timer interruption. Upon start of this processing, in S21, "1" is substituted for a variable "n" in S21. Then, an output signal from the retraction sensor 90 at the "n-th" head portion is read. For example, at the initial start up phase, the output signal from the sensor 90 of the first head portion 1 is read in S23. Then, in S25, judgment is made as to whether or not the bed case 51 is positioned at its using position.

If the bed case 51 is not positioned at its using position (S25:No), the routine goes into S27 where a command is issued on the n-th head portion to execute processing for dealing with the malfunction. Stopping the needle bar 19 may be the typical malfunction dealing processing described later. Then in S29, the above described hook shaft driving control (FIG. 9) is interrupted with respect to the n-th head portion, for example, with respect to the bed portion 7 if n=1. At the same time, stop signal is output to the driver circuit 154 to stop rotation of the rotary hook drive motor 58. Accordingly, rotation of the rotary hook 59 is stopped at an angular rotational position where the downwardly moving sewing needle 11 is not mechanically interfered with the rotary hook 59.

If the bed case 51 is at its using position (S25:Yes), the malfunction dealing processing with respect to the n-th head portion is cleared in S31, and the control circuit 150 allows the sewing machine control circuit 100 to execute its ordinary control routine. Then in S33, the above described hook shaft drive control routine with respect to the n-th head portion is re-started. Therefore, stop command on the rotary hook 59 is cleared.

After the steps S29 or S33, "1" is added to "n" in S35, and judgment is made as to whether or not "n" is equal to "4" in S37. If "n" is not equal to "4" (S37:No), the routine returns back to S23. Thus, the steps S23 through S37 are again executed with respect to the respective head portions 1, 2, 3. If these steps have been carried out with respect to the head portion 3, "n" becomes equal to "4" in S37. Thus, the routine is returned back to the main stitching routine. With the above described processing, if the bed case 51 of the n-th head portion is at its using position (S25: Yes), execution of ordinary stitching processing is granted (S31, S33), and if the bed case 51 of the n-th head portion is out of using position (S25: No), stitching operation is stopped (S27, S29).

Next, malfunction dealing processing will be described with reference to a flowchart of FIG. 11. This processing is executed by the sewing machine control circuit 100 in response to the command signal issued in the step of S27. First, the needle bar jumping solenoid 41 is maintained at its ON state in S41. Then, the linking pin 19*a* of the needle bar 19 is disengaged from the vertically movable segment 22, so that the driving force is not transmitted to the needle bar 19. Then in S43, the angular rotation angle of the spindle 27 is read by way of the first encoder sensor 122 and the spindle point of origin sensor 123.

Then in S45, judgment is made as to whether or not a timing of the disengagement of the linking pin 19*a* from the vertically movable segment 22 is in the downward moving stroke of the needle bar 19. More specifically, a predetermined delay period may exist from the ON timing of the needle bar jumping solenoid 41 to the actual disengagement timing of the linking pin from the vertically movable segment 22. This delay is due to the operation period of the needle bar jumping solenoid 41. Therefore in S45, judgment is made as to whether or not the timing after elapse of the predetermined delay period is within the downward moving period of the needle bar 19. If the determination falls Yes, the routine goes into S47 where the needle bar stop solenoid 48 is actuated. As a result, the rubber piece 49 is depressed against the needle bar 19 to impart braking force thereto.

If the judgment in S45 falls No, or after the step S47, the spindle drive stop command is transmitted to the driver circuit 105 in S49, and as a result, the spindle motor 95 is immediately stopped. Then, the wiper solenoid 40 is fixed to its OFF state in S53 to maintain stop state of the wiper 39. Further, even through the thread cutting motor 84 is rotated regardless of using or non using position of the bed case 51, the operation of the thread cutting mechanism is prohibited because of the mechanical disconnection between the linking piece 85 and the pivot lever 86 (because the pin 85*a* is disengaged from the oblong slot 86*b*) when the bed case 51 is moved to its retracted position. Then, the routine is ended.

Thus, according to the depicted embodiment, if the bed case 51 is not at its using position (S25:No), power transmission to the needle bar 19 is prohibited to stop movement of the needle bar 19 and the sewing needle 11 (S41) and, the rotation of the rotary hook 59 is stopped at the specific angular position where the needle bar 11 is not mechanically interfered with the rotary hook 59 (S29). Further, if the needle bar 19 is at its downward moving stroke (S45:Yes), braking force is imparted on the needle bar 19 to promptly stop the downward movement thereof (S47). Consequently, even if the bed case 51 is not at its using position and the needle bar-rotary hook meet timing is deviated to improper timing, mechanical interference between the sewing needle 11 and the rotary hook 59 can be prevented.

With the arrangement, even if start command of sewing operation is issued while the associated one of the bed portions 7 through 9 is not positioned at its using position, or even if the bed portion is accidentally displaced from its normal using position during sewing operation, the mechanical interference between the needle and the rotary hook attendant to the bed portion can be prevented, and occurrence in degraded stitching is avoidable. The stopping of the sewing needle 11 can also avoid mechanical interference with the throat plate 52. (The interference may occur between the vertically moving sewing needle and a slanted throat plate). Moreover, the stopping of the rotary hook 59 can also avoid occurrence in degraded stitching due to insufficient retaining of the bobbin thread or due to entanglement of the bobbin thread to the rotary hook. Because the needle is not driven while the bed portion is not at its using position, load imparted on the driving system can be reduced, which in turn, avoids wasteful electrical power consumption, and reduces probability of enrolling or entanglement of the workpiece fabric and the thread.

Further, if the bed case 51 is not positioned at its using position (S25:No), the wiper 39 is maintained at its stop position (S53), and the operation of the thread cutting mechanism 75 is prohibited. Therefore, it is possible to avoid unwanted trapping of foreign objects by the actuator, i.e., the wiper 39 in the non-used bed portion and avoid insufficient retaining of the needle thread by the wiper in the non used bed. Moreover it is possible to avoid accidental scratching or injury to the workpiece fabric held on the non-used bed portion by the thread cutting mechanism 75.

Further, in the illustrated embodiment, each bed portion 7, 8, 9 is displaced to its retracted or shunt position by downward pivotal movement thereof about the pivot shaft 82. With this arrangement, maintenance and inspection to the driving systems of the rotary hook 59 and the thread cutting mechanism 75 can be facilitated. Moreover, each bed portion can be easily assembled in the sewing machine by a simple structure, i.e. by mere fixing of the bracket 81 to the base frame 4. Thus entire structure of the sewing machine can be simplified.

Figure 11:
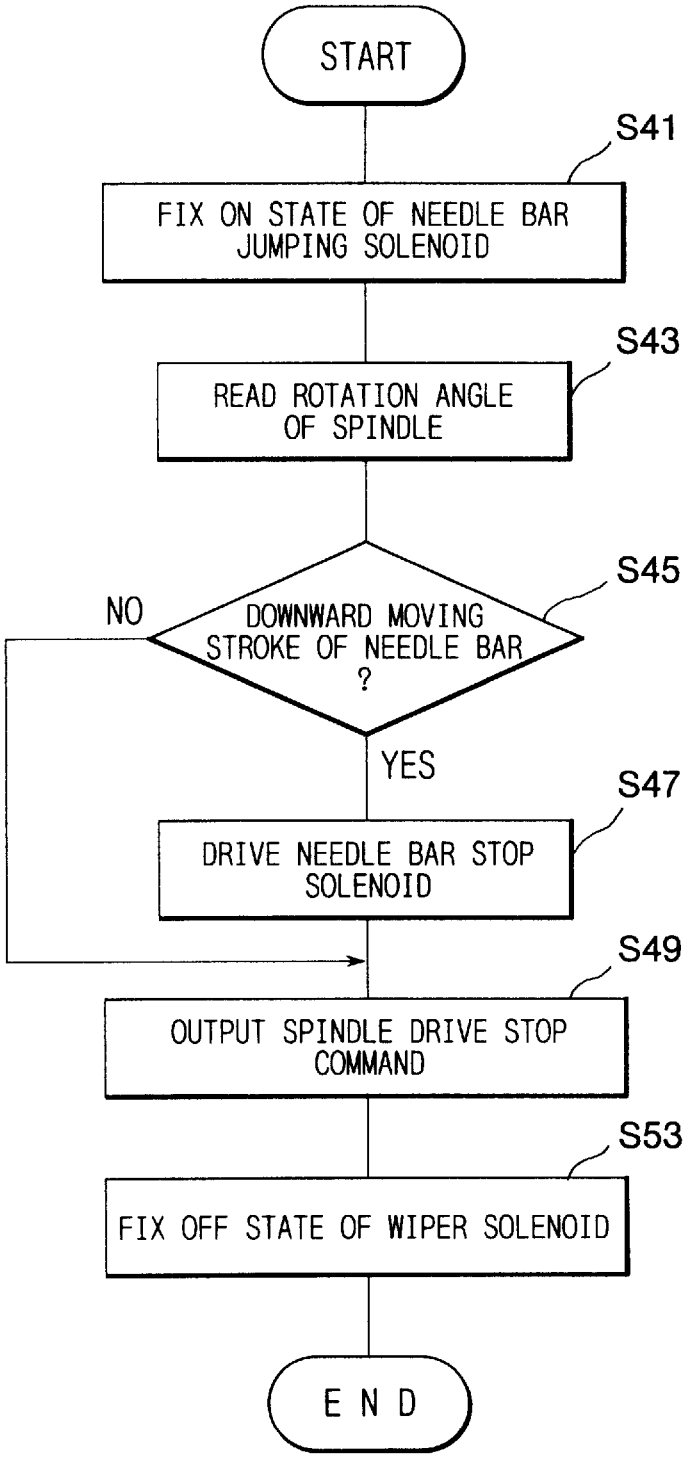
FIG. 11 is a flowchart showing malfunction dealing processing i.e., control to a needle bar and a wiper solenoid in response to occurrence of a malfunction according to the embodiment.
Figure 12:
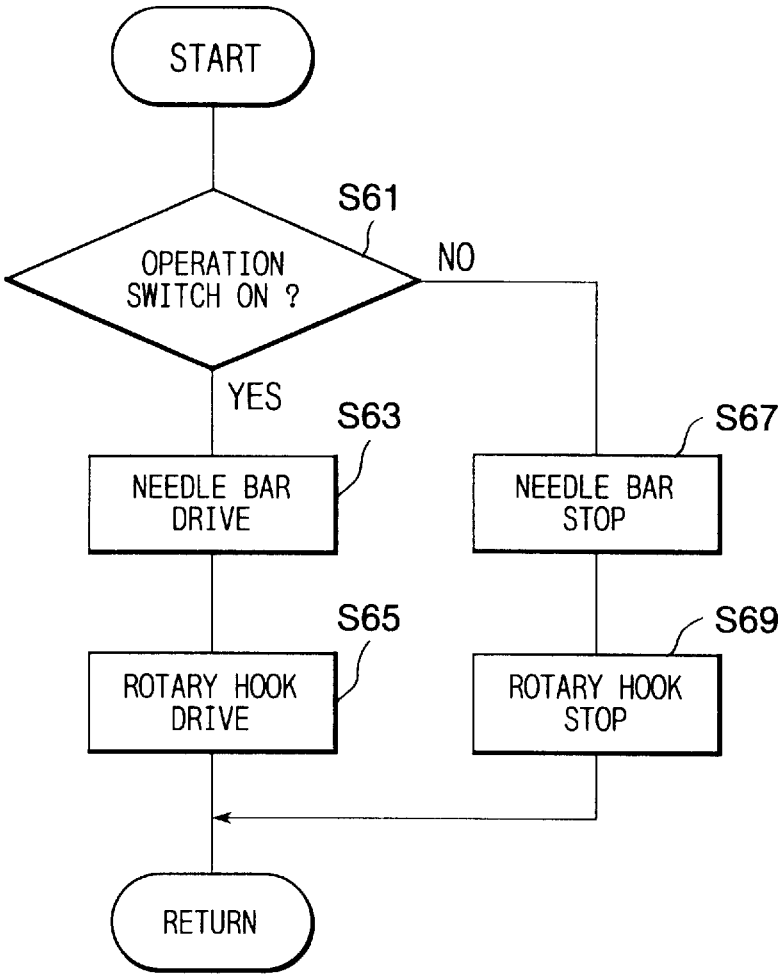
FIG. 12 is a flowchart showing an operation phase switching routine according to the embodiment.

According to above described embodiment in connection with the flowcharts of FIGS. 10 and 11, the sewing needle 11 and the rotary hook 59 are automatically switched between their driving phase and stopping phase in response to the detection signal from the retraction sensor 90. However, this switching can be performed manually by the manipulation of the operation switch 119. This manual malfunction dealing processing or operation phase switching processing will be described with reference to a flowchart shown in FIG. 12.

If the operation switch 119 is manipulated, the sewing control circuit 100 will execute the operation phase switching processing. First in S61, judgment is made as to whether the operation switch is switched to ON. In this case, if the operation switch 119 is of the type in which it is held either conductive or non conductive, ON or OFF state can be judged by detecting the conductive or non conductive state. Alternatively, if the operation switch 119 is of the type in which it is only conductive at the time of manipulation and issues pulse signal, ON/OFF state is stored in a memory, and the memory content is alternately rewritten to either ON or OFF by the pulse signal, and ON/OFF state can be judged by the stored memory content.

If the operation switch 119 is switched ON (S61:Yes) the needle bar driving is started in S63 and driving of the rotary hook 59 is also started in S65. This step S65 is identical with the hook shaft drive routine shown in FIG. 9. On the other hand, if the operation switch 119 is switched OFF (S61:No), the driving of the needle bar 19 is stopped in S67 and driving of the rotary hook 59 is also stopped in S69. The step S67 is identical with the malfunction dealing processing shown in FIG. 11, and the step 69 is identical with the step S29 of FIG. 10.

In this way, according to the depicted embodiment, the needle 11 and the rotary hook 59 can be also switched to either driving or non-driving state by the manual operation of the operation switch 119. Therefore, if the operator acknowledge any malfunction not attributed to the actual sewing operation, the drive of the needle 11 and the rotary hook 59 can be stopped easily by the operator's manipulation to the operation switch 119. Thus, idle driving of the needle and the rotary hook can be prevented.

According to the above described steps S41, S47, S49, S29, S67 and S69, power transmission from the spindle motor to the needle bar is shut off, and the rotary hook drive motor is changed to its stop phase. Therefore, the sewing needle can be stopped while maintaining rotation of the spindle motor. Accordingly, driving force of the spindle motor can still be transmitted to other moving components, and only a specified sewing needle can be stopped. On the other hand, the rotary hook drive motor is independent of other motors, and therefore, stoppage of the rotary hook drive motor does not affect other movable components. Thus, the rotary hook drive motor can be directly and independently stopped, to reduce wasteful power consumption of the drive system associated with the rotary hook.

While the invention has been described in detail and with reference to the specific embodiments thereof, it would be apparent to those skilled in the art that various changes and modifications may be made therein without departing from the spirit and scope of the invention. For example, in the depicted embodiment, the sewing needle 11 and the rotary hook 59 are both stopped at their non-interefence positions. However, only one of the needle and the rotary hook can be simply stopped. Further, as a modification, a flag can be set so as to ignore the detection signal from the thread cutting sensor 118, if the bed portion is not at its using position and if the thread cutting sensor generating the detection signal is associated with the non-use bed portion. Alternatively, the pressure foot 38 can be fixed to its elevated position by the actuation of the pressure foot drive solenoid 111, if the bed portion is not at its using position. In the latter case, unwanted operation of the pressure foot (actuator) can be eliminated. As another modification, if one of the bed portions (for example the bed portion 8) is in the retracted position, this retracted position is detected by the retraction sensor 90, and a processing for automatically expanding stitching regions for the other bed portions 7 and 9 can be started in response to the detection signal from the retraction sensor 90.

Further, in the depicted embodiment, the bed portions are hingedly secured to the base frame 4. However, the bed portion can be provided detachably from the base frame 4, or can be moved upwardly or downwardly while maintaining its horizontal posture.

Further, the present invention can be applied to various types of sewing machines such as a sewing machine other than an embroidery machine, a single head sewing machine, and a sewing machine in which a hook shaft is drivingly connected to a spindle motor by an endless belt. The present invention is particularly advantageous in case of the multiple heads type sewing machine, because a selection of a particular head among the multiple heads can be easily made for the purpose of performing sewing operation only by the selected head by simply moving the remaining multiple heads to their retracted positions without any manipulation to ON/OFF switches associated to each head. Accordingly, entire operability of the multiple head type sewing machine can be enhanced.

Further, instead of the manipulation of the manual operation switch 119, the switch 119 can be switched automatically in response to the deviation of the bed portion. Furthermore, instead of direct manual operation of the operation switch 119 by the operator, the operation switch can be electrically connected to a computer through a signal transmission line, so that the operation switch can be switched upon receipt of a switching signal transmitted from the computer. Furthermore, it is possible to operate the operation switch 119 so as to positively stop driving of the needle and the rotary hook those being not used for the present stitching in spite of the fact that bed portion is positioned at its correct using positon.

What is claimed is:

1. A sewing machine for stitching a workpiece fabric with a needle thread and a bobbin thread comprising:

a base frame;

at least one head portion mounted on the base frame;

at least one bed portion movable between a using position and a retracting position with respect to the at least one head portion, the bed portion accommodating therein a rotary hook containing the bobbin thread;

a needle bar having a lower end fixedly provided with a sewing needle through which the needle thread is passed, the needle bar being supported and reciprocally driven by the at least one head portion, a stitching being formed by cooperation of the sewing needle and the rotary hook;

judgment means for making judgment as to whether or not the at least one bed portion is at the using position; and stitch suspension means for stopping the cooperation of the sewing needle and the rotary hook when the judgment means determines that the bed portion is out of the using position.

2. The sewing machine as claimed in claim 1, wherein the stitch suspension means comprises needle stopping means for stopping a vertical reciprocating movement of the needle bar and the associated sewing needle.

3. The sewing machine as claimed in claim 2, further comprising:

a spindle motor;

a spindle driven by the spindle motor and rotatably supported in the at least one head portion;

a selective engaging portion for providing a driving connection between the spindle and the needle bar for driving the needle bar by the spindle and for selectively providing a disconnection between the spindle and the needle;

and wherein the needle stopping means comprises means for disconnecting the needle bar from the spindle.

4. The sewing machine as claimed in claim 3, wherein the means for disconnecting comprises:

a needle bar jumping solenoid connected to the selective engaging portion, the needle bar jumping solenoid providing a first position in response to the determination that the bed portion is out of the using position for disconnecting the needle bar from the spindle; and a biasing member normally biasing the needle bar to a jumping position, the needle bar being moved upwardly by the biasing member upon disconnection of the needle bar from the spindle.

5. The sewing machine as claimed in claim 3, wherein the needle stopping means further comprising means for braking downward movement of the needle bar after the disconnecting means disconnects the needle bar from the spindle.

6. The sewing machine as claimed in claim 4, wherein the needle stopping means further comprises means for braking downward movement of the needle bar after the disconnecting means disconnects the needle bar from the spindle.

7. The sewing machine as claimed in claim 6, wherein the braking means comprises:

a swing plate pivotally supported to the at least one head portion;

a braking element fixed to the swing plate, the braking element being in selective contact with the needle bar;

downward movement judging means for judging whether or not the needle bar is moved downwardly; and a needle bar stop solenoid connected to the swing plate for moving the swing plate toward and away from the needle bar, the needle bar stop solenoid providing a first position at which the braking element is in frictional contact with the needle bar when the downward movement judging means determines that the needle bar is moved downwardly, and a second position at which the braking element is moved away from the needle bar.

8. The sewing machine as claimed in claim 7, wherein the needle bar stopping means further comprises means for stopping rotation of the spindle motor for stopping the rotation of the spindle after the needle bar stop solenoid provides the first position.

9. The sewing machine as claimed in claim 1, further comprising:

a pressure foot disposed in the at least one bed portion for holding the workpiece fabric;

a wiper provided below the pressure foot and having a hook portion for trapping and holding the needle thread; and a wiper solenoid connected to the wiper for moving the wiper between a trapping position and a retracted position.

10. The sewing machine as claimed in claim 9, further comprising means for deenergizing the wiper solenoid to provide the retracted position of the wiper when the judgment means determines that the bed portion is out of the using position.

11. The sewing machine as claimed in claim 1, further comprising a thread cutting mechanism including a thread cutting motor, and means for deenerging the thread cutting motor when the judgment means determines that the bed portion is out of the using position.

12. The sewing machine as claimed in claim 1, wherein the at least one bed portion has one end pivotally connected to the base frame, the at least one bed portion being pivotable between a horizontal position serving as the using position and a downwardly slanting position serving as the retracted position.

13. The sewing machine as claimed in claim 1, wherein the stitch suspension means comprises rotary hook stopping means for stopping rotation of the rotary hook.

14. The sewing machine as claimed in claim 13, further comprising a rotary hook drive motor connected to the rotary hook for rotating the rotary hook, and wherein the rotary hook stopping means comprises means for deenergizing the rotary hook drive motor when the judgment means determines that the bed portion is out of the using position.

15. The sewing machine as claimed in claim 2, wherein the stitch suspension means further comprises rotary hook stopping means for stopping rotation of the rotary hook.

16. The sewing machine as claimed in claim 15, further comprising a rotary hook drive motor connected to the rotary hook for rotating the rotary hook, and wherein the rotary hook stopping means comprises means for deenergizing the rotary hook drive motor when the judgment means determines that the bed portion is out of the using position.

17. A sewing machine comprising:

a spindle motor;

a spindle driven by the spindle motor;

a needle bar vertically reciprocatingly driven by the spindle, the needle bar having a lower end fixed with a sewing needle, the sewing needle permitting a needle thread to pass therethrough;

a selective power transmission mechanism for selectively providing a power transmission state where the needle bar is drivingly connected to the spindle and a power disconnecting state where the needle bar is disconnected from the spindle;

a rotary hook storing therein a bobbin thread, a stitch being formed on a workpiece fabric by cooperation of the sewing needle and the rotary hook;

a rotary hook drive motor connected to the rotary hook for drivingly rotating the rotary hook; and stitch suspending means for providing the power disconnecting state of the selective power transmission mechanism and for stopping rotation of the rotary hook drive motor, so that the sewing needle and the rotary hook are in stopped phase while the spindle is still rotating.

18. The sewing machine as claimed in claim 17, further comprising an operation switch selectively providing ON state or OFF state, the stitch suspending means providing the power disconnecting state and stopping rotation of the rotary hook drive motor upon turning OFF the operation switch.

19. The sewing machine as claimed in claim 18, wherein the operation switch comprises a manual switch for manually providing the ON or OFF state.

20. The sewing machine as claimed in claim 18, further comprising:

at least one bed portion movable between a using position and a retracting position; and judgment means for making judgment as to whether or not the at least one bed portion is at the using position, the operation switch being connected to the judgment means and rendered OFF when the judgment means determines that the at least one bed portion is out of the using position.

* * * * *